US005394317A

United States Patent [19]

Grenga et al.

[11] Patent Number: 5,394,317

[45] Date of Patent: Feb. 28, 1995

[54] LAMP REFLECTOR

[76] Inventors: John J. Grenga, 9 Fairview Dr., Greenville, R.I. 02828; Richard P. Eannarino, 91 Mann Rd., Smithfield, R.I. 02917

[21] Appl. No.: 970,623

[22] Filed: Nov. 3, 1992

[51] Int. Cl.[6] ..... F21V 7/09

[52] U.S. Cl. ..... 362/347; 362/297/346

[58] Field of Search ..... 362/347, 348, 297, 341, 362/260, 346, 296

[56] References Cited

U.S. PATENT DOCUMENTS

| | | | |
|---|---|---|---|
| 1,730,571 | 10/1929 | Hamilton | 362/347 |
| 1,788,934 | 1/1931 | Wood | 362/347 |
| 2,591,661 | 4/1952 | McCandless | 362/217 |
| 4,078,169 | 3/1978 | Armstrong | 362/122 |
| 4,229,779 | 10/1980 | Bilson et al. | 362/260 |
| 4,293,901 | 10/1981 | Hermandez | 362/348 |
| 4,307,150 | 12/1981 | Roche | 428/336 |
| 4,536,830 | 8/1985 | Wisniewski | 362/223 |
| 4,562,517 | 12/1985 | Pankin | 362/147 |
| 4,645,714 | 2/1987 | Roche et al. | 428/458 |
| 4,683,526 | 7/1987 | Krogsrud et al. | 362/346 |
| 4,748,543 | 5/1988 | Swarens | 362/219 |
| 4,760,505 | 7/1988 | Cole, Jr. | 362/225 |
| 4,794,501 | 12/1988 | Bartenbach | 362/260 |
| 4,907,143 | 3/1990 | Lasker | 362/225 |
| 4,924,359 | 5/1990 | Lindae et al. | 362/347 |
| 5,205,632 | 4/1993 | Crinion | 362/347 |

FOREIGN PATENT DOCUMENTS

| | | | |
|---|---|---|---|
| 442246 | 8/1991 | European Pat. Off. | 362/260 |

OTHER PUBLICATIONS

S. Cornbleet, "Microwave and Optical Ray Geometry", pp. vii–vi, 11–35, 49–57, 135–140 1983.

Donald G. Burkhard et al., SPIE, vol. 692, "A Different Approach to Lighting and Imaging: Formulas for Flux Density, Exact Lens and Mirror Equations and Caustic Surfaces in Terms of the Differential Geometry of Surfaces", SPIE, vol. 692, *Materials and Optics for Solar Energy Conversion and Advanced Lighting Technology* (1986), pp. 248–272.

3M Construction Markets, "3M Silverlux TM Reflectors vs. Anodized Polished Aluminum", Aug. 1991.

"How to Improve Your Quality of Light and Cut Energy Costs by up to 50% with Reflect-A-Light TM", *Energy Users News, Nov., 1992, p. 12.*

"Metal Optics Intelligent Lighting Systems", *Energy Users News,* Nov., 1992.

3M Construction Markets Department, "The More You Know About Silverlux TM Reflectors . . . the More You Want Silverlux Reflectors", Aug. 1989.

3M Construction Markets Department, "The More You Know About Silverlux TM Reflectors . . . The More You Want Silverlux Reflectors", Jul. 1989.

3M Energy Control Products, "Silverlux TM Reflectors Cut Your Lighting Energy Costs in Half", Aug. 1991.

*Primary Examiner*—Ira S. Lazarus
*Assistant Examiner*—Alan Cariaso
*Attorney, Agent, or Firm*—Fish & Richardson

[57] ABSTRACT

A lamp reflector comprises a pre-formed member molded from a polymer into a smooth and continuously curved shape. The members have a rigidity characteristic sufficient for maintaining its shape. A reflecting layer is bonded directly to the molded member to provide a reflector surface without facets or sharp angles. The shape of the member is comprised of a rear portion being an involute spline and side portions being defined by conic sections. The method of providing such a reflector decreases the amount of light reflected back into the lamp and trapped or absorbed within the lighting fixture. The method further eliminates the need for adhesive layers between the metal reflecting layer and the substrate which generally decreases the optical efficiency of the luminaire.

10 Claims, 12 Drawing Sheets

LAMP REFLECTOR

BACKGROUND OF THE INVENTION

This invention relates to lamp reflectors, and more particularly to reflectors for optimizing the optical efficiency of a fluorescent lamp luminaire.

In a fluorescent lamp, phosphor crystals are coated on the inner surface of a glass envelope containing a mercury vapor. Electron bombardment of the vapor from a cathode generates ultraviolet light and causes the phosphor crystals to emit visible light from the surface of the coated envelope in both radial and tangential directions. Because it is generally desired that the light be directed to particular areas, reflectors are generally used to help direct the emitted light to the target areas.

A typical fluorescent lighting unit (known as a luminare), for example, has a housing known as a troffer for supporting one or more fluorescent tubular lamps and the necessary wiring and electrical hardware that provide power to the lamps. The troffer generally has a box-like structure often used as a reflector with the light rays incident on the side and rear portions of the troffer being either absorbed or reflected by the surface. The inner surfaces of the troffer are typically painted white in order to decrease the amount of light absorbed by the surfaces. In those regions where the lamp is relatively close to the troffer, particularly where the troffer surface is directly behind the lamp, a significant portion of the light rays are either reflected back into the lamp or indirectly guided to the illuminated area by making multiple light scattering reflections along the walls of the troffer before exiting the troffer.

With rising energy costs, efforts are being made to improve the optical efficiency of lamp reflectors for lighting fixtures. The optical efficiency of a reflector represents the total amount of light directed to an area relative to the total amount of light generated by the lamp.

Reflector materials used for the reflection of fluorescent light are fabricated by laminating metal films onto metal support sheets. One approach for providing such a reflector material includes applying an adhesive layer onto an extruded polymer substrate sheet that is sufficiently thick to support the subsequently deposited polymer and metal films. Prior to applying the adhesive, the metal support sheet is often provided with a passivation layer to protect the surface of the metal support sheet from contamination, and an additional protective film is then applied over the adhesive layer. A metal film is vapor deposited over the polymer film followed by anti-tarnish, UV absorber, and abrasion resistance coatings. A polymer film is then bonded onto the metal film with a front cover film deposited over the polymer to protect the reflector material during shipment and handling. The metal film has mirror-like qualities, known as specular metals, such as silver or aluminum. The metal film is typically vacuum metallized onto the polymer film.

The abrasion resistant layer often includes the ultraviolet light absorber for screening ultraviolet light from the adhesive layer and polymer film. Ultraviolet light over long periods of time can cause degradation and molecular breakdown within the polymer film causing the film to "yellow". This breakdown of the polymer results in a reduction in the specularity of the reflector material. The reflector material is fabricated into a lamp reflector by first cutting the laminated sheets to desired dimensions and cutting or punching lamp clearance holes in the laminated film. A press is then used to shape the reflector material with a series of bends providing a concave shaped member having a number of reflective facets. The sheet of reflector material is shaped with the press by marking locations of each bend, carefully placing the marked positions along the bending element of the press, and bringing the press arm down to crease the sheet with an appropriate amount of force. This operation is repeated until the multi-faceted reflector is completed. The fabrication of some multi-faceted reflectors may involve well over thirty bend operations. The reflector is then ready to be mounted within the light fixture along with lamp brackets and other hardware.

SUMMARY OF THE INVENTION

One general aspect of the invention is fabricating a reflector for a lamp by providing a substrate having a predetermined reflector shape with the substrate having rigidity sufficient to maintain the predetermined reflector shape, and bonding a reflecting layer directly onto an inner surface of the substrate.

Embodiments of the invention include the following features.

The reflector shape of the substrate is a concave continuum providing an inner concave surface to which the reflecting layer is directly bonded. The substrate is molded using extrusion, thermoforming, or injection molding processes. The reflecting layer is a metal bonded to the substrate using a vacuum deposition process, such as sputtering. The substrate is molded into a shape having cut-out portions to accommodate lamp components, such as lamp sockets. Portions of the metal are removed from the substrate photolithographically to allow light to pass through the substrate. The surface of the substrate is treated to smooth it before the metal reflecting layer is bonded to the substrate. A reflection-enhancing coating (e.g. silicon monoxide) is applied over the metal reflecting layer. Aluminum is used as the metal reflecting layer to reflect energy having wavelengths in the ultraviolet spectrum which may be harmful to the substrate.

Another aspect of the invention is a lamp reflector for directing light emitted from a lamp towards an area of desired illumination including at least one continuously curved member having a pair of curved portions, each expressed by a different function. The first curved portion extends from a region behind the lamp with respect to the area desired to be illuminated to a side region of the lamp, and the second curved portion continues from the side region to a region extending toward the area desired to be illuminated.

Embodiments of the invention include the following features.

The lamp has a diametric axis extending from the region behind the lamp to the area desired to be illuminated and the first curved portion begins along the diametric axis. The first and second functions represent parametric equations such as conic or cubic sections. The lamp reflector has a first continuously curved member disposed to a first side of the diametric axis with respect to the area desired to be illuminated and a second continuously curved member disposed at a second side of the diametric axis. In one embodiment, the curved members are symmetrical about the diametric axis of the lamp, while in another embodiment the curved members are asymmetric about the diametric axis.

The invention yields a highly efficient light reflector that is easy and economic to manufacture. By molding the substrate into a continuously curved shape using a high strength but flexible polymer material, the reflecting layer is bonded to the substrate without the need for intermediate adhesive layers. Moreover, the continuously curved shape of the reflector eliminates angled and faceted portions having creased bends which tend to reduce specularity diffuse and scatter light rays in many directions. A reflector without creased bend portions has improved specular reflectance characteristics because stretch and stress points on the metal reflecting layer are eliminated.

The concave curved shape of the lamp reflector permits light rays emitted from the lamp to be directed out of a lighting fixture generally with a single reflection. The rear curved portion of the reflector has a shape such that light rays emanating from the rear of the lamp are reflected toward the area to be illuminated without being directed back into the lamp or to another portion of the reflector.

Other advantages and features of the invention will be apparent from the following description and from the claims.

DESCRIPTION OF THE PREFERRED EMBODIMENTS

Figure 1:
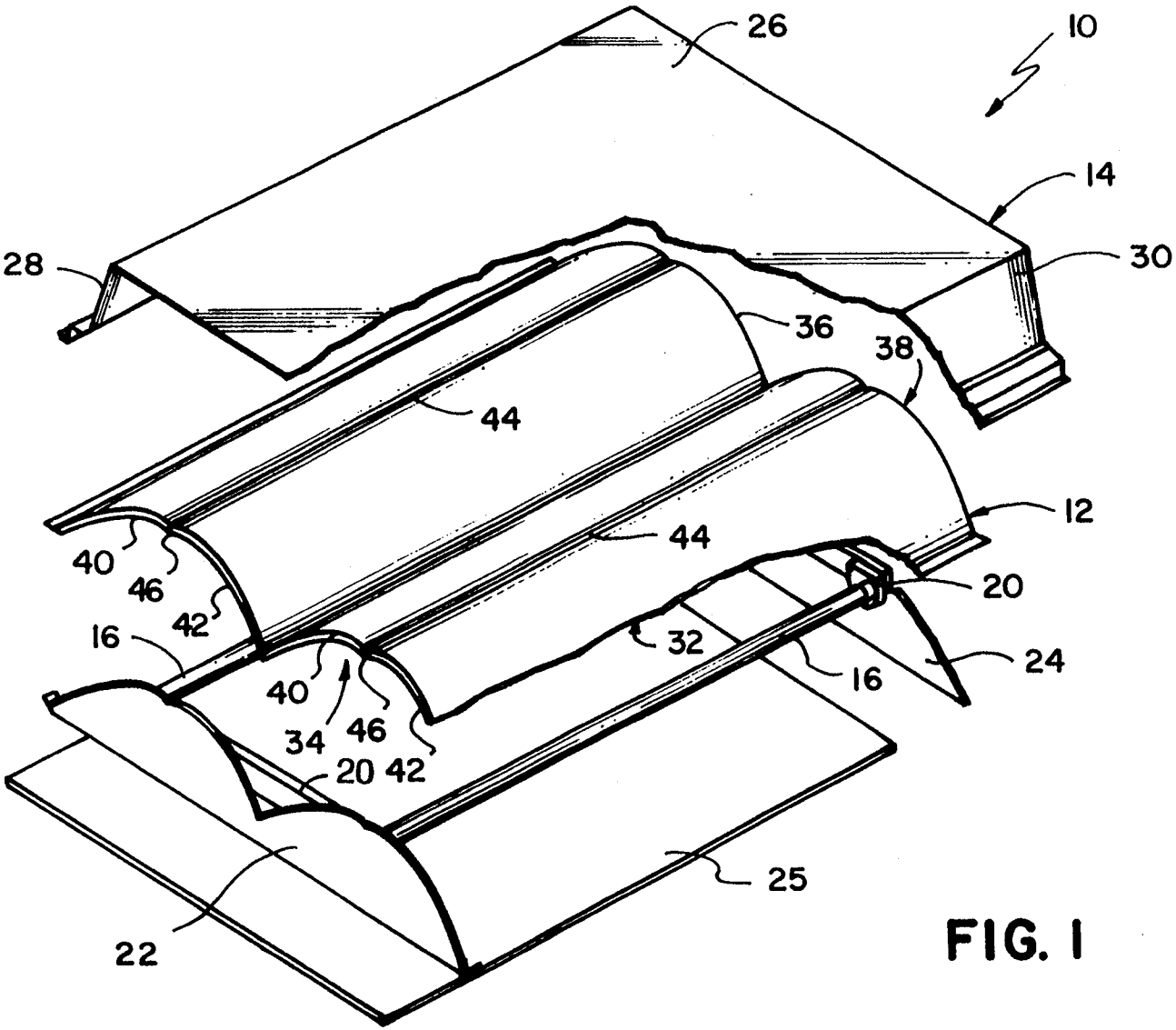
FIG. 1 is an exploded view of a lighting fixture having a lamp reflector according to the invention.
Figure 2:
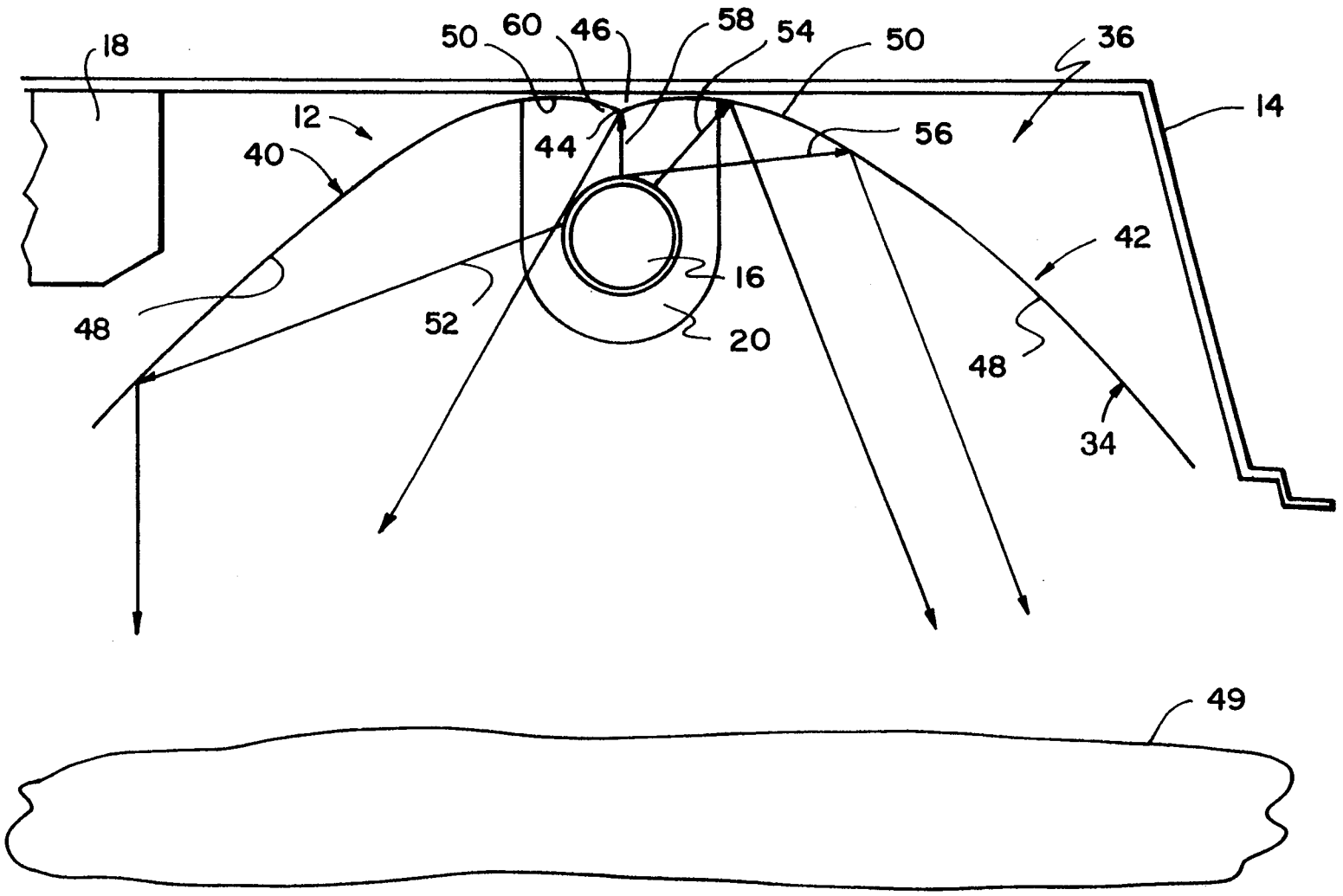
FIG. 2 is a cross-section of the lighting fixture of FIG. 1 after assembly.
Figure 3A:
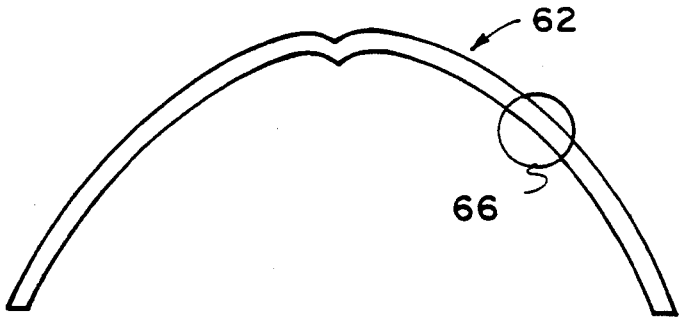
FIGS. 3*a*–3*g* show different stages of the fabrication process of the lamp reflector of FIG. 1.
Figure 3C:
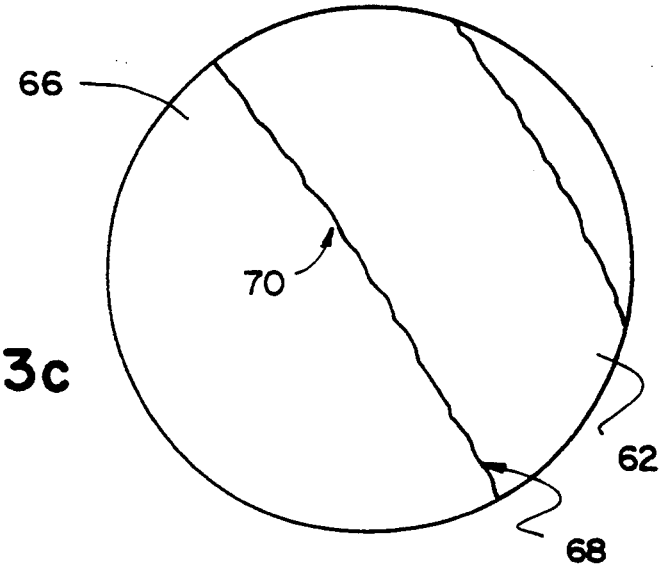
Figure 3B:
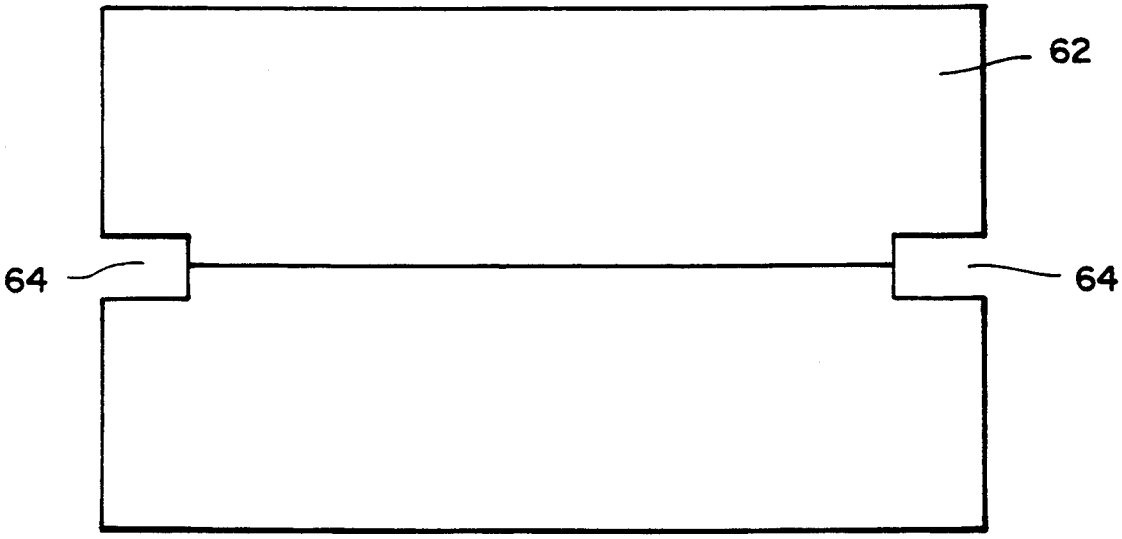
Figure 3D:
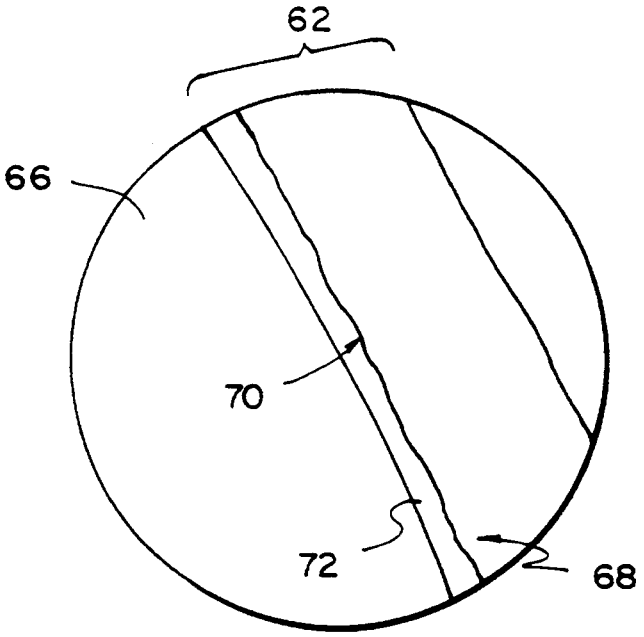
Figure 3E:
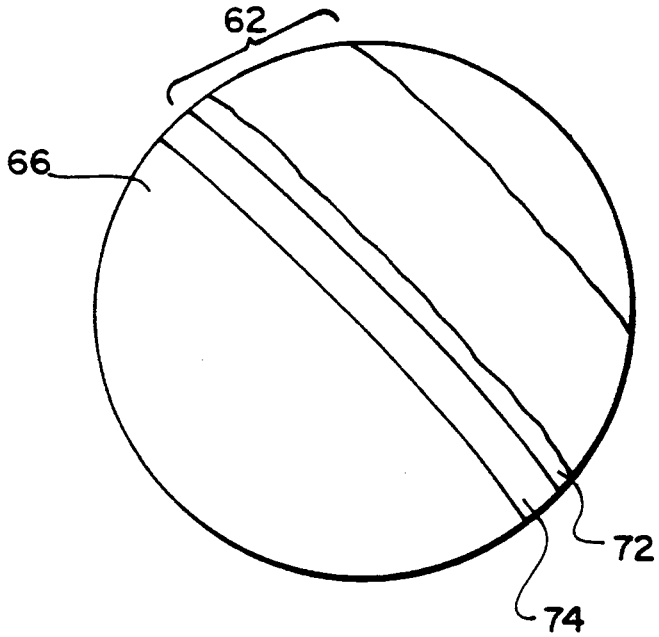
Figure 3F:
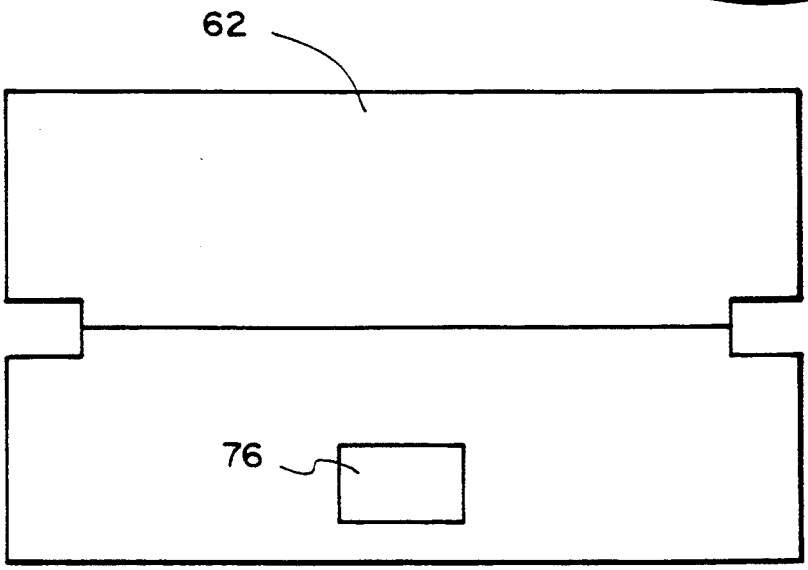
Figure 3G:
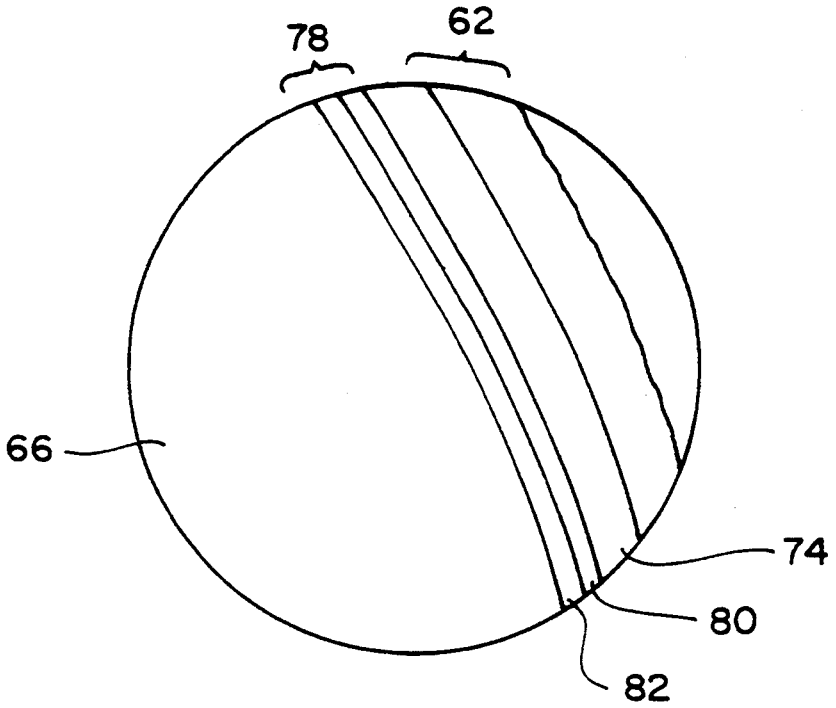

As shown in FIGS. 1 and 2, a fluorescent light fixture 10 includes a reflector 12 disposed between a troffer 14 and a pair of fluorescent lamps 16. A ballast 18 is mounted within the light fixture 10 to provide the proper starting voltage to lamps 16 through lamp sockets 20 via electrical wiring (not shown). End members 22, 24 are disposed at each end of the fixture 10 and have shapes conforming to the curved portions of reflector 12 for supporting light fixture 10 and lamp sockets 20 within troffer 14. A prismatic lens 25 is attached to troffer 14 and end members 22, 24 to enclose fixture 10 and to diffuse the exiting light.

Troffer 14 is a standard lighting enclosure having a rear wall 26 and side walls 28, 30 which extend outwardly from the rear wall at obtuse angles. The dimensions of the troffer 14 are standard and depend on the length and number of fluorescent lamps used in the fixture. Troffer 14 is fabricated from a sheet of steel or aluminum which can be easily pressed into a desired shape and can support attachment of the reflector 12, end members 22, 24 and any electrical hardware needed for powering lamps 16 (e.g., wiring, sockets, ballasts).

Reflector 12 is molded using a relatively strong and flexible polymer material and has a metal reflecting layer 32 deposited on an inner concave surface 34 of reflector 12. Reflector 12 includes a pair of identical members 36, 38 joined along one side of their entire lengths.

As shown in FIG. 2, member 36 is representative of one half of reflector 12 and is associated with one of the pair of lamps 16. Member 36 has a pair of concave curved surfaces 40, 42 attached at a spine portion 44 defining a cusp 46. Each one of the pair of concave curved surfaces 40, 42 of members 36, 38 is defined by a side curved portion 48 and a rear curved portion 50. Each curved surface 40, 42 has a shape such that light incident on their surfaces is directed to the area to be illuminated 49 with a single reflection.

Side curved portion 48 of member 34 has a curved shape conforming to an off-axis pseudo-parabola. The curved shape is considered to be off-axis in the sense that the true focus of side curved portion 42 lies along a plane offset from a diametric axis running through the center of lamp 16 from a region behind lamp 16 to area to be illuminated 49. The shape of side curved portion 42 moreover does not conform to a true parabola because it does not have a unique directrix. The directrix is a fixed line with the distance from the focus to any point along the parabolic curve being equivalent to the length of an orthogonal line from that point to the fixed line. Instead, as will be discussed later in conjunction with FIG. 4, portions of side curved portion 42 are curve fitted to form a single curve each having its own unique directrix.

Rear curved portion 50 is closest to lamp 16 and accordingly receives the richest source of the luminous flux radiating from the lamp. In order to provide more efficient reflection in this region, rear curved portion 50, has a shape developed from the construction of a nephroid curve. The geometry of a nephroid provides a compact geometry that is capable of reflecting flux incident on the surface of rear curved portion 50 from lamp 16 forward and out of the lighting fixture 10 to area to be illuminated 49 with a single reflection. For example, light rays 52, 54, and 56 emitted from the surface of lamp 16 are incident to various portions of side and rear curved portions 48, 50. Each light ray 52, 54, and 56 is directed to area of illumination 49 without being incident again on reflector 12. Similarly, light ray 58 is emitted from a backside portion of lamp 16 and travels a short distance before being incident on rear curved portion 50 at a point 60 directly behind lamp 16. Rear curved portion 50 has a shape that directs light ray 58 out of light fixture 10 to area of illumination 49 without being reflected back into lamp 16 or to another portion of curved surface 34.

Referring to FIGS. *3a–3g*, a process for fabricating lamp reflector 12 is shown. Although members 36 and 38 are generally fabricated as a single reflector 12, only one of the members 36, 38 is shown, and it is appreciated that reflectors for multiple adjacent lamps (See FIG. 1) may be fabricated using the same process.

Referring to FIG. *3a*, reflector 12 has a base substrate 62 molded into a concave shape using any of a variety of processes including extrusion, thermoforming, or injection molding. Substrate 62 is a polycarbonate polymer such as Makroion, a polycarbonate polymer manufactured by Miles Polymer Division—Plastics, Miles Inc., Pittsburgh, Pa. Polycarbonate polymer is a glass-like plastic having characteristics of high structural strength, flexibility, dimensional stability, wide temperature use, high creep resistance, high electrical resistivity and flame retardancy. Creep resistance is the ability of an elastic material to retain its original shape after being mechanically stressed or deformed.

As is shown in FIG. *3b*, substrate 62 includes apertures or cut-out portions 64 needed for the placement of lamp components such as lamp sockets 20 (FIG. 1), wiring, or ballasts. If substrate 62 is formed using an extrusion process, it is generally necessary to trim the molded piece to its proper length and to provide necessary holes for mounting holders, brackets and the like. In addition, the edges of the pre-formed substrate 62 may require trimming to remove unwanted excess material.

As shown in FIG. *3c*, a magnified portion 66 of substrate 62 reveals that an inside reflecting surface 68 has surface irregularities 70. Referring to FIG. *3d*, substrate 62 is treated with a reflectance improvement layer 72 to cover surface irregularities 70 such that a glossier and mirror-like quality is provided for reflecting surface 50. The reflectance improvement layer 72 is a liquid plastic, such as urethane sprayed over reflecting surface 68 and cured using an ultraviolet light source. Reflectance improvement layer 72 has a thickness between 50–100 micrometers in its cured state. Reflectance improvement layer 72 enhances the reflective characteristics of reflector 12 and increases the specular reflectance of reflecting layer 74 (FIG. *3e*), subsequently deposited over substrate 62. (Specular reflectance is defined as coherently reflected light obeying Snell's law of reflection. Non-specular reflection is defined as incoherent light scattered by the interface.)

Referring to FIG. *3e*, reflecting layer 74 is a specular metal bonded onto substrate 62. Reflecting layer 74, such as silver or aluminum, is sputtered onto polymer substrate 62 in a high vacuum at a temperature below 50° C. to provide rapid coating of substrate 62. In order to provide a reflecting surface of high specularity, the specular metal should be of laboratory quality purity and the pressure within the vacuum be as low as possible (e.g. $10^{-6}$ Torr). The thickness of reflecting layer 74 is in the range of 500 angstroms (Å) to 1500Å, preferably about 650Å. Providing thicknesses greater than 1500Å increases the potential for cracking due to stress induced changes in the shape of substrate 62. In applications where metal reflecting layer 74 does not reflect ultraviolet light, substrate 62 is made with a polymer material having ultraviolet light inhibitors blended therein to prevent yellowing of the substrate 62.

Referring to FIG. *3f*, after deposition of reflecting layer 74 over substrate 62, masked portions 76 of the metal can be removed or selectively deposited from substrate 62 to allow light emitted from lamp 16 (FIGS. 1 and 2) to pass through portions of reflector 12 and illuminate areas above lighting fixture 10. In one application, for example, a storage warehouse has an upper area above lamp fixture 10 which requires lighting with a relatively low intensity level as compared to the main floor area below light fixture 10. Removing a portion of reflecting layer 74 from reflector 12 permits light to illuminate these upper areas. Photolithographic methods or any suitable alternative approaches may be used to remove the metal without requiring the cutting or manual peeling of the metal which increases the possibility of damage to reflector 12.

Optional coatings 78 may be used to enhance reflection and protect either or both substrate 62 and reflecting layer 74 depending on the particular materials used or application of reflector 12. Referring to FIG. *3g*, for example, a reflection-enhancing layer 80 that improves the specular characteristics of the metal is applied over the metal reflecting layer 74. An anti-tarnishing coating 82 is another layer which may be deposited over reflecting layer 74 to avoid oxidation of reflecting layer 74 which generally reduces its specularity characteristic. Because silver has a relatively rapid rate of oxidation, when used as reflecting layer 74, indium oxide ($In_2O_3$) is used for anti-tarnishing coating 82.

Optional coating 78 may be a single layer coating of a multifunctional acrylate having an ultraviolet light absorber and a photocuring agent disposed within. Benzotriazole (1.5% by volume) for providing UV light absorption and Igracure 907™, a product of Ciba-Geigy, Plastics and Additive Division, Hawthorne, N.Y., (0.5% by volume) to allow rapid curing of coating 78 when exposed to ultraviolet light are mixed into the polymer acrylate. Coating 78 can be cured in less than 100 milliseconds thereby providing better control of the thickness of coating 78. Such a multifunctional acrylate also provides oxidation resistance, abrasion resistance and a high clarity glass-like finish with a single layer.

Figure 4:
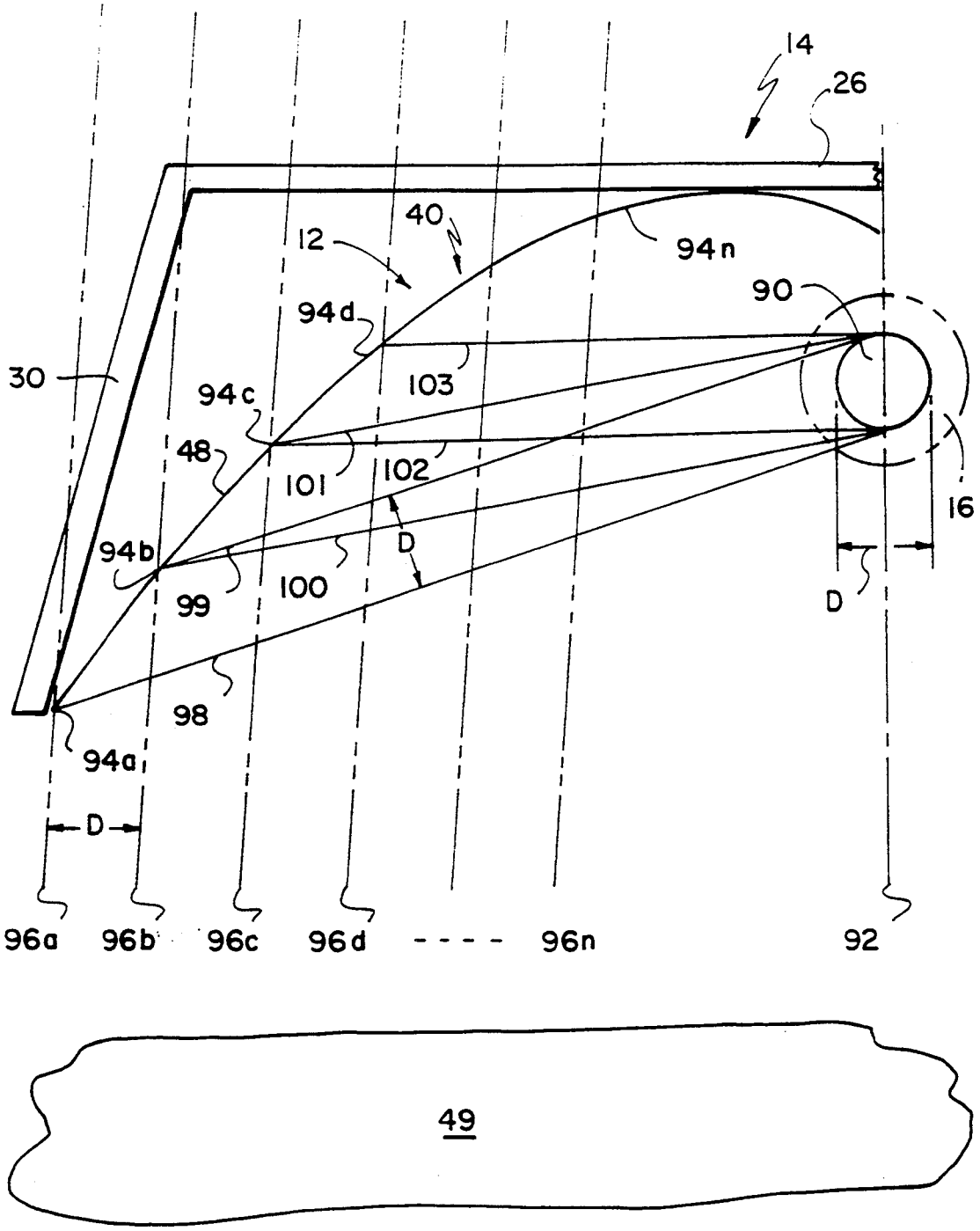
FIG. 4 is a diagrammatic view illustrating a method for determining the curvature of curved side portions of the lamp reflector of FIG. 1.
Figure 5:
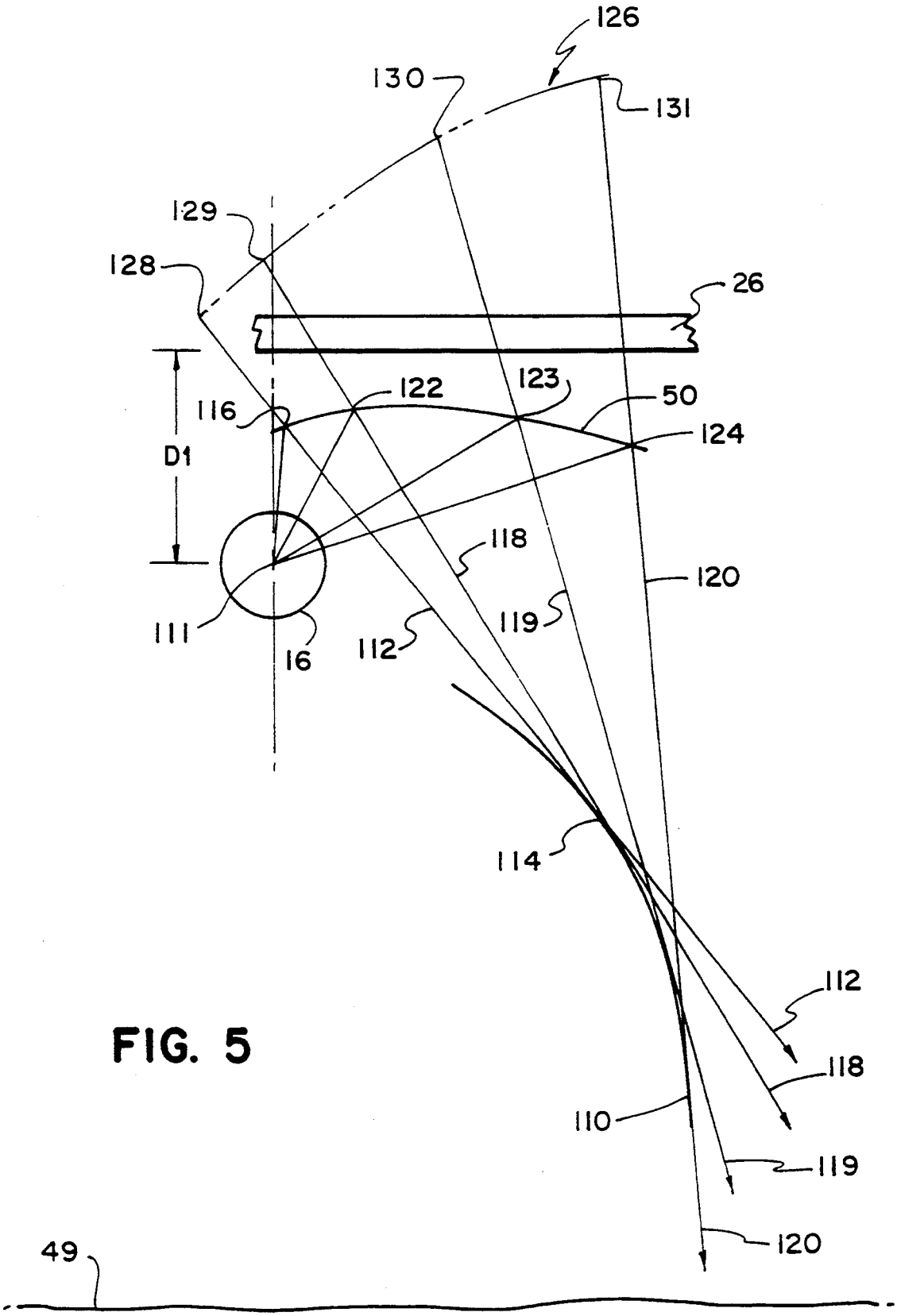
FIG. 5 is a diagrammatic view illustrating a method for determining the curvature of a curved rear portion of the lamp reflector of FIG. 1.
Figure 6:
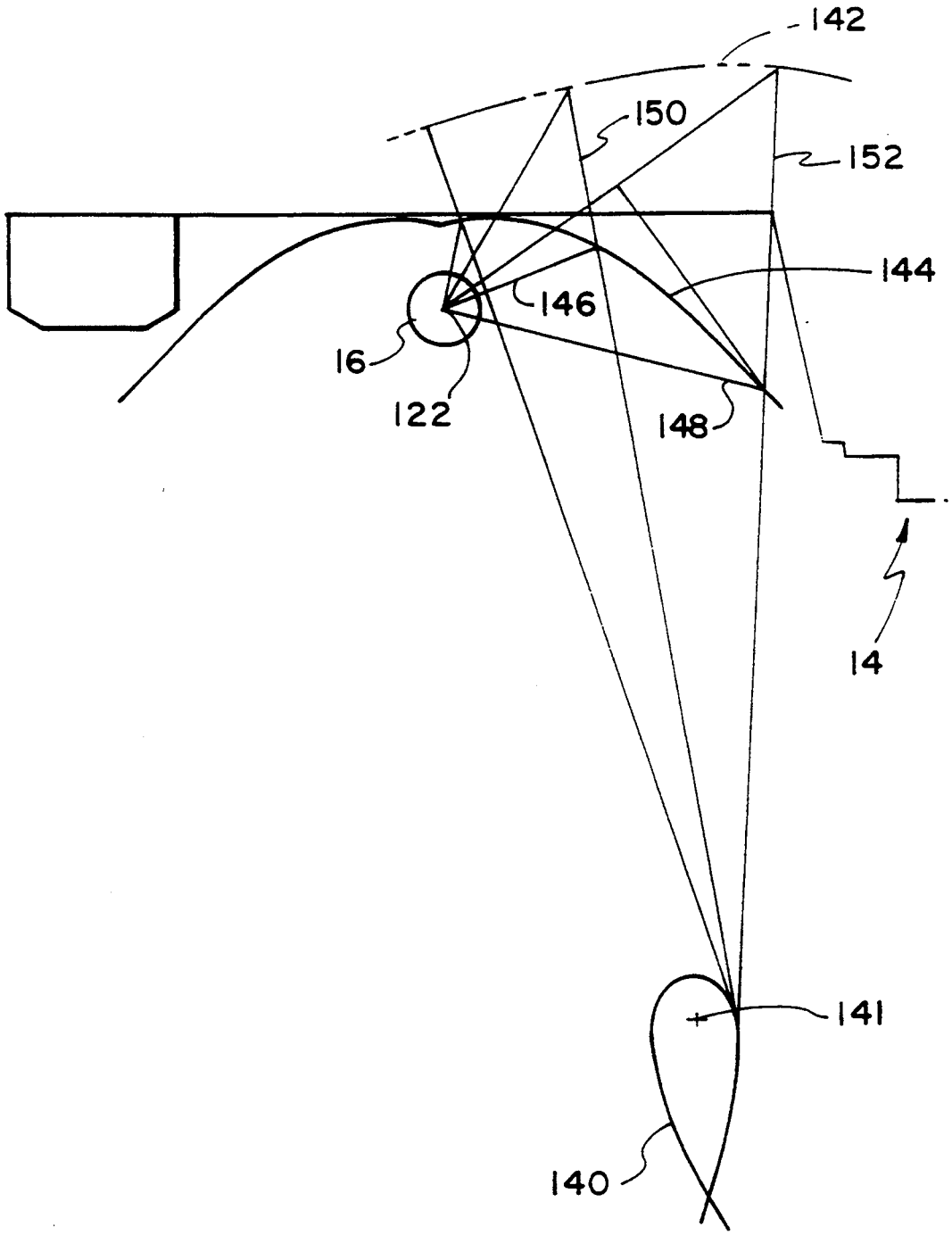
FIG. 6 is a diagrammatic view of an alternative method for determining the curvature of curved side and rear portions of the lamp reflector of FIG. 1

Reflector 12 is shown in FIG. 4 to illustrate one technique for constructing the curved portions of reflector 12. The technique involves curve fitting a number of points generated from ray tracings of a lamp image. Although the technique may be used to construct the entire reflector curve (See FIG. 8), it is particularly well suited for generating side portions 48 of reflector 12. Other construction techniques discussed in conjunction with FIGS. 5 and 6 are particularly well suited for developing the rear portion 50 of reflector 12.

A lamp image 90 represents fluorescent lamp 16 and has here, a diameter (D) of one-half that of the actual diameter of lamp 16. It will become apparent that as lamp image 90 is made smaller, a greater number of points for representing the shape of side curved portion 48 are generated, thereby providing a more accurate representation of curve 48. Lamp image 90 is located along a center axis 92, extending from a region behind lamp 16 to an area to be illuminated 49, of reflector 12 and lamp 16 and is within the periphery of lamp 16. Because reflector 12 is supported within the confines of troffer 14, it has a shape limited to a certain extent by the geometry of troffer 14. In order to generate points representing curve 48, a starting point 94*a* is placed close to the outer edge and forward most point of troffer 14. Although starting point 94*a* can be located at a region other than along the boundaries of troffer 14, placing starting point 94*a* as shown in FIG. 4 is convenient and will provide a reflector having a surface area geometry that provides good spreading of reflected lamp images and will simultaneously fit within the available space of troffer 14.

Using starting point 94*a* as a reference, a series of parallel construction lines 96*a*–96*n* are generated. Each line 96*a*–96*n*, spaced from an adjacent one by diameter (D) of lamp image 90, represents the direction of light rays emitted from lamp 16 which are incident to points on reflector 12 intersecting each of lines 96*a*–96*n*. First construction line 96*a* is skewed with respect to center axis 92 of reflector 12 at an angle of about 5° to conform with the angle of side walls 28, 30 of troffer 14. The slight skew of the angle improves the spreading of the lamp images over the desired area of illumination 49. Construction lines 96*a*–96*n* are to be used with a series of tangent and parallel lines 98–103 drawn from the outer edge of lamp image 90.

Ray tracing approaches generally use the center point of the lamp source as the origin of light rays. However, because light rays from fluorescent lamp 16 are generated from its surface rather than its center (as is the case with some incandescent lamps), using the surface of lamp 16 provides a more accurate representation of the source of emitted light rays. A first tangent line 98 is drawn from a first tangent point on the front surface of lamp image 90 to starting point 94*a* located along first parallel construction line 96*a*. A corresponding first parallel line 99 is drawn from a second point tangent to and on the back surface of lamp image 90 that is angularly spaced exactly 180° from the tangent point of first tangent line 98. Accordingly, first parallel line 99 is parallel to and spaced by a distance equal to diameter D of lamp image 90 from first tangent line 98. First parallel line 99 intersects construction line 96*b* at a point 94*b*.

The intersections of first tangent line 98 and first parallel line 99 with first and second parallel construction lines 96*a*, 96*b* respectively, provides points 94*a* and 94*b* defining a first segment of curve 36. Similarly, a second tangent line 100 is generated between a third tangent point on the front side of lamp image 90 to point 94*b* and a second parallel line 101, parallel to second tangent line 100, is generated from a fourth tangent point on lamp image 90 until it intersects construction line 96*c*. Once again, second tangent line 100 and second parallel line 101 are spaced by diameter (D) such that their intersections with first and second parallel construction lines 96*b* and 96*c* respectively, provide points 94*b* and 94*c* defining a second segment of curve 36.

Continuing this process provides a series of curve-fitting points 94*a*–94*n* representing intersections of the pairs of corresponding parallel lines 98, 100, 102 and tangent lines 99, 101, 103 with construction lines 96*a*–96*n*. The series of points 94*a*–94*n* define points along side portion 48 of the reflector 12 which are used to determine locations at which a bending press is used to provide a faceted reflector. However, in accordance with the present invention, curve fitting of points 94*a*–94*n* is performed to provide a continuous curved side portion 48. The curve fitting process may use any of a number of well-known numerical curve fitting approaches such as the least-squares method defined by the equation $y=a_0+a_1*x+a_2*x^2+\ldots+a_m*x^m$, where x and y represent coordinates on a Cartesian plane and $a_O-a_m$ represent constant coefficients.

Unlike a faceted reflector, a reflector having continuously curved side portions allows the light rays incident on their surfaces to reflect toward the area to be illuminated in parallel with respect to each other. The constructed curve is not precisely parabolic because points 94*a*–94*n* are referenced from the surface of lamp image 90 and not a common point source, such as the center of the lamp image 90. Accordingly, every segment between each pair of points 94*a*–94*n* has a unique directrix.

In using the curve fitting technique described above, a large number of points is generally not necessary to provide a smooth continuous curve along those portions of the curve spaced from lamp 16 a distance more than several lamp diameters. On the other hand, where lamp 16 is relatively close to reflector 12, such as rear curved portion 50 of reflector, it becomes much more difficult to provide a curve using the curve fitting approach. At rear portion 50, the length of construction lines approach the diameter of lamp image 90. In this case, it becomes increasingly difficult to provide a curved shape capable of reflecting light rays from behind lamp 16 with a single reflection. The immediately following discussion provides an alternative approach for directing light rays more efficiently from rear portion 50 of reflector 12.

Complex reflector surfaces having curved portions may be optically derived using a mathematical operation known as co-involution. Mechanically, co-involution can be described as the generation of a curve from a point of a perfectly flexible inextensible thread that is kept taut as it is wound upon or unwound from another curve, known as a caustic curve. The caustic curve is tangent to an envelope of rays that have been reflected or refracted from a corresponding curved surface known as an involute or zero-distance phase front. The desired curve shape for rear curved portion 50 is derived from the caustic curve and the involute curve. The shape of the caustic curve, often called the caustic signature, will determine the shape of the rear curved portion 50. For example, co-involution of a caustic curve that is a circle will always generate a curve that is a nephroid. The caustic curve is selected such that the resulting rear curved portion 50 in combination with side curved portion 48 provides a reflector 12 that fits within troffer 14. For this reason, the type and position (with respect to lamp 16 and troffer 14) of the caustic curve used to generate the reflector curved is typically determined empirically.

Referring to FIG. 5, caustic curve 110 is one of a variety of curves (e.g. parabolas, circles, cardioids) used to generate rear portion 50 of curve 42. Point source 111, representing a point within or along lamp 16 is placed a predetermined distance (D1) from rear wall 26 of troffer 14. Caustic curve 110 is positioned between lamp 16 and the desired area of illumination 49 such that light rays reflected from some point along rear curved portion 50 will be tangent to points along caustic 110. A first ray 112 tangential to a point 114 on caustic 110 represents a desired reflected path for any light ray emitted from lamp 16 which is incident at a point 116 along desired rear portion curve 50. Point 116, lying on first ray 112 is placed between point source 111 and rear wall 26 to represent a point along desired rear curved portion 50. Second, third and fourth rays 118, 119, and 120 are provided, each tangent to caustic 110, representing corresponding second, third and fourth reflected paths for light rays reflected from desired rear portion curve 50 at second point 122, third point 123 and fourth point 124, respectively.

A second construction curve, known as the involute or zero-distance phase front (ZDPF) 126, is related to caustic curve 110 such that the distance between point source 111 and points 116 and 122–124 along desired rear portion curve 50 equals the distance between points 116 and 122–124 and corresponding points 128–131, respectively, along involute 126. In other words, the length of the line between points 111 and 116 is the same as the length of the line between points 116 and 128. Similarly, the lengths of lines between point 111 and each of points 122–124 equal the lengths of lines between points 122–124 and points 129–131, respectively. With this relationship, all points along desired rear portion curve 50 between points 116, 122, 123, and 124 can be generated.

Other embodiments are within the scope of the claims. For example, if the troffer geometry permits, the technique of co-involution also permits the construction, in general form, of an entire complex curved reflector surface (both side and rear portions). The entire reflector surface can be described algebraically with a single function. As shown in FIG. 6, an alternate embodiment of the invention has a caustic curve known as Tschirnhausen's cubical spline 140 properly placed in relation to troffer 14 and lamp 16. Involution of the spline 140 provides a corresponding involute 142 such that a family of light rays orthogonal to involute 142 and tangent to spline 140 can be used to generate points along a reflector 144. As was the case in the example shown in FIG. 5, Tschirnhausen's spline 140 is related to involute 142 such that the distance of a line from lamp 16 to a point on reflector surface 144 is equal to the length of a portion of a line along the ray passing through that point which extends from the point to involute 142. For example, line segments 146, 148 from lamp 16 to reflector 144 have lengths equal in length to line segments 150, 152 respectively. Tschirnhausen's cubical spline 140 is defined by the equation:

$r=a/[\cos^3(\theta/3)]$ where $a$=scaling constant $r$=radius vector of the spline $\theta$=angular spacing (from 0 to $\pi$)

Constant a is a scaling factor for enlarging or reducing the relative size of the spline and is generally determined empirically as a function of the geometry of troffer 14 and the location of lamp 16 with respect to troffer 14. Radius vector r is a function of the angular spacing $\theta$ and has an origin 141 at an empirically selected point in the transverse plane of reflector 12 with respect to lamp 16 and troffer 14. The origin 141 of radius vector r represents the locus of center of curvature for spline 140. Co-involution of Tschirnhausen's spline 140 using involute curve 142 results in the generation of reflector 12 having a curved shape known as a nephroid curve 144. Nephroid curves are well-suited for luminare applications where lamp 16 has a circular cross-section and troffer 14 has a rectangular cross-section.

A conventional fluorescent lamp reflector and a fluorescent lamp reflector in accordance with the invention were tested for their illuminance distribution characteristics. The lamp reflector arrangement tested included a pair of fluorescent lamps disposed between a troffer and a pair of fluorescent lamps in the arrangement similar to that of FIG. 1. The fluorescent lamps used in the test were commercially available Octolume® FO17/41 fluorescent lamps manufactured by Phillips Lighting Co., Somerset, N.J., rated at 1325 lumens per lamp and powered by energy efficient electronic ballasts, a product of MagneTek Co., Triad TM Division, Huntington, Ind. The fluorescent lamps were oriented identically in their respective reflectors, each mounted eight feet from the floor in a totally dark test room and were tested under the same operating and environmental conditions (e.g. voltage, temperature).

The conventional lamp reflector tested was a multifaceted (31 facets) Model #40EM lamp reflector, manufactured by New England Sun Control, Inc., Smithfield, R.I. The specular material used for the conventional art reflector was a silver laminated film known as Silverlux TM, a product of 3M Construction Markets, St. Paul, Minn. The tested lamp reflector of the invention had a continuously curved shaped generated using the technique of co-involuting a Tschirnhausen cubical spline as described above in conjunction with FIG. 6. Moreover, the lamp reflector was fabricated using the process described above in conjunction with FIGS. 3*a*–3*g*.

Referring to Table I below, illuminance readings were measured at eleven locations along a pair of orthogonal axes (FIGS. 11–12), in the eight foot room along a horizontal plane 30 inches above the floor using a standard photometer. The illuminance readings in units of footcandles were measured with and without a prismatic lens.

TABLE 1

| Data Location # | With Prismatic Lens | | Without Prismatic Lens | |
|---|---|---|---|---|
| | Reflector of Invention (footcandles) | Conventional Reflector (footcandles) | Reflector of Invention (footcandles) | Conventional Reflector (footcandles) |
| 1 | 47 | 36 | 62 | 41 |
| 2 | 43 | 31 | 56 | 37 |
| 3 | 34 | 25 | 45 | 31 |
| 4 | 30 | 20 | 38 | 25 |
| 5 | 40 | 30 | 55 | 37 |
| 6 | 32 | 26 | 44 | 31 |
| 7 | 26 | 21 | 38 | 26 |
| 8 | 42 | 33 | 40 | 36 |
| 9 | 30 | 27 | 29 | 36 |
| 10 | 45 | 33 | 45 | 39 |
| 11 | 28 | 27 | 32 | 32 |

Figure 11:
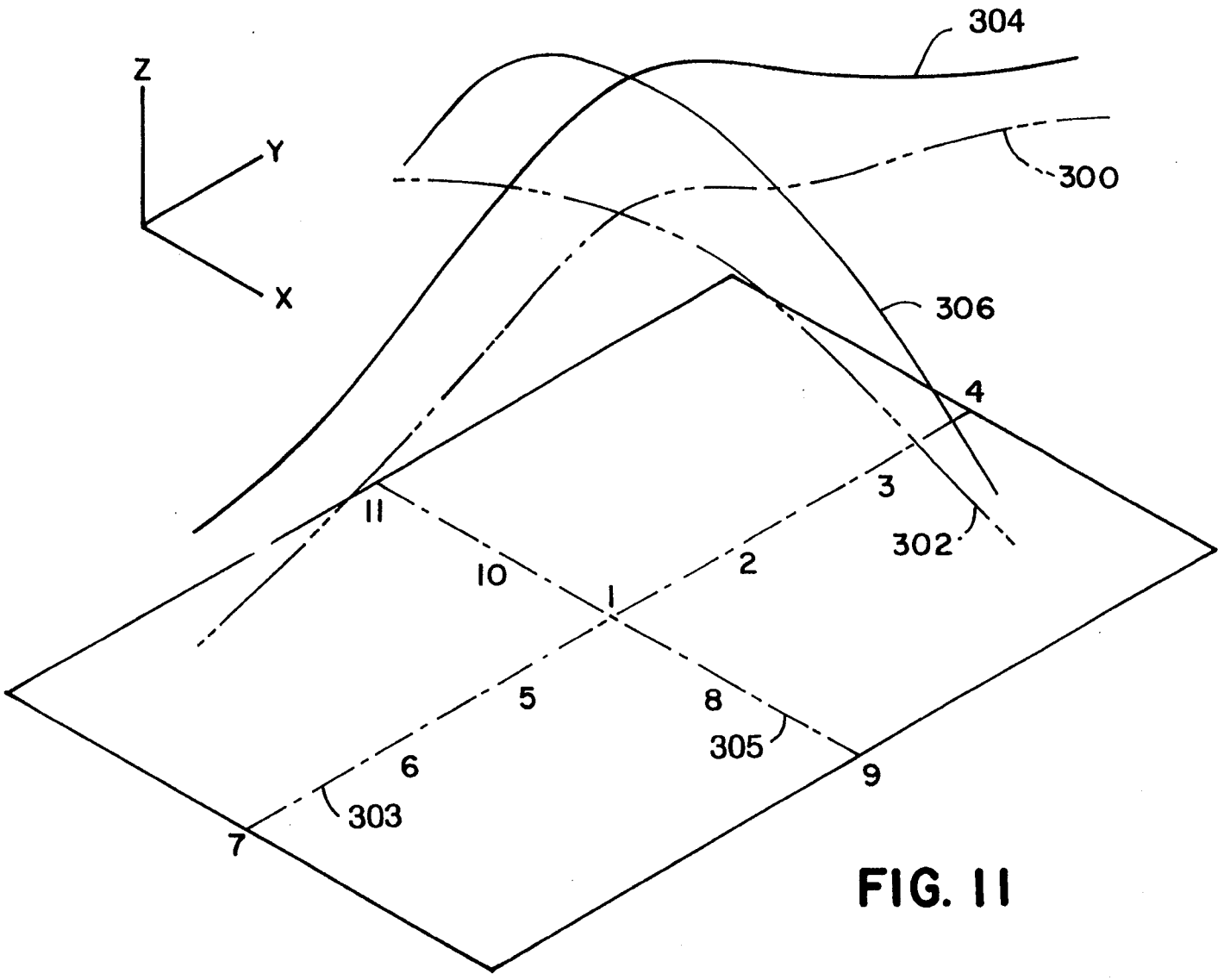
FIG. 11 is a graphical representation of illuminance at preselected areas for a typical prior art fluorescent lamp reflector and a typical fluorescent lamp reflector in accordance with the present invention with prismatic lens.

Referring to FIG. 11, the illuminance data of Table I for both the conventional lamp reflector and lamp reflector of the present invention is shown, with each reflector having a prismatic lens 25 placed over the open face of troffer 14. Curves 300, 302, shown as dashed lines, represent the illuminance data of the conventional reflector along the pair of orthogonal axes 303, 305 of the room, respectively. On the other hand, curves 304, 306, shown as solid lines, represent the reflector of the present invention along the same axes 303, 305.

Figure 12:
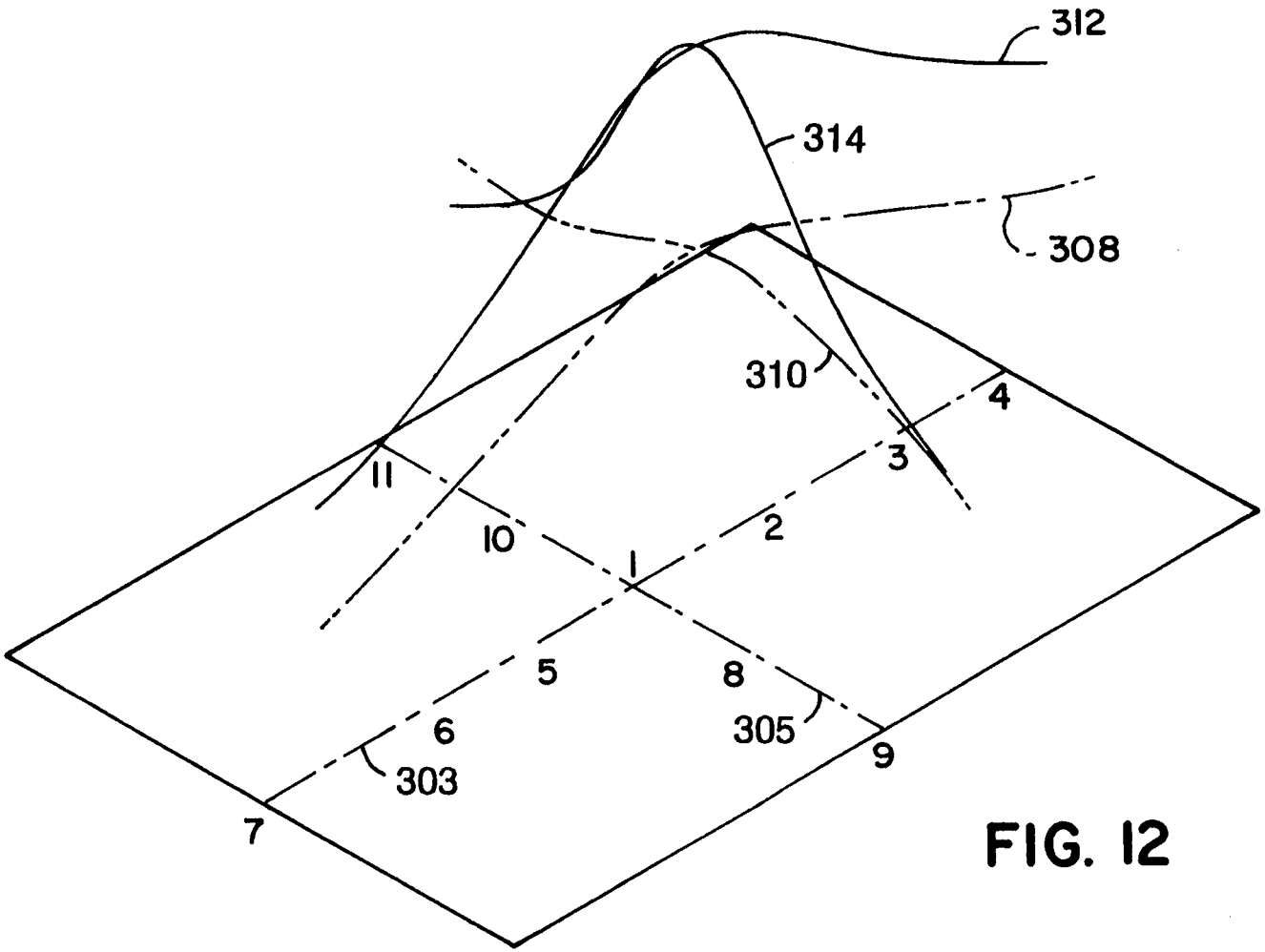
FIG. 12 is a graphical representation of illuminance at preselected areas for a typical prior art fluorescent lamp reflector and a typical fluorescent lamp reflector in accordance with the present invention without prismatic lens.

Referring to FIG. 12, the illuminance data of Table I for both reflectors is graphically shown with prismatic lens 25 removed. Curves 308, 310 (dashed lines) represent the illuminance data of the conventional reflector along the pair of orthogonal axes 303, 305 of the room, respectively, while curves 312, 314 represent the illuminance of the present invention along the same axes 303, 305.

Figure 7:
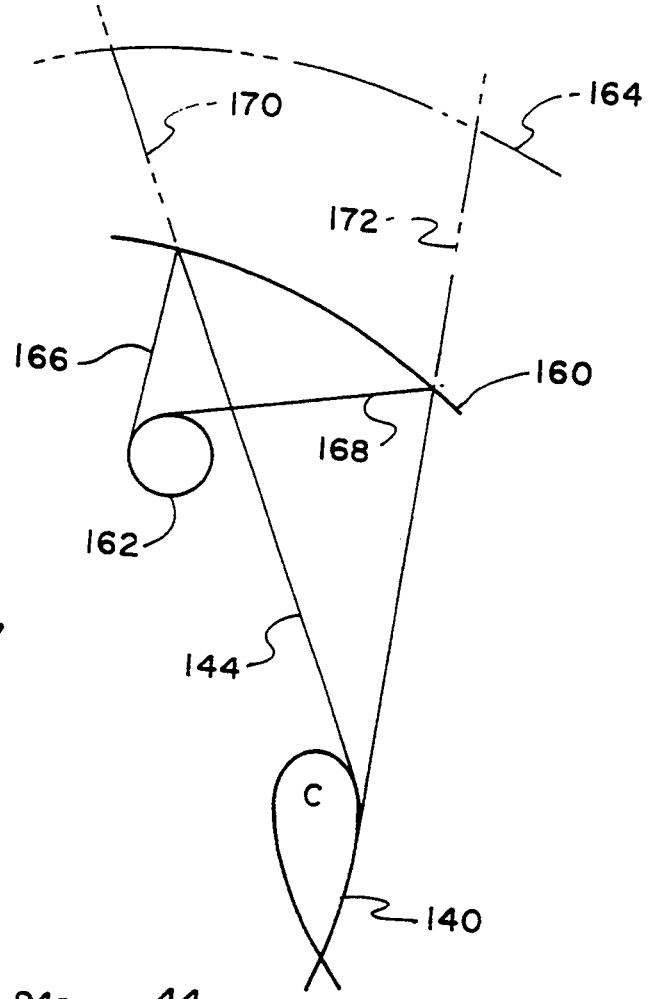
FIG. 7 is a diagrammatic view of an alternative method for determining the curvature of curved side and rear portions of the lamp reflector of FIG. 1

Alternatively, as shown in FIG. 7, a reflector 160 may be derived by substituting a circularly shaped caustic 162 representing the outer annular surface of lamp 16 for point source 64. Co-involution of circularly shaped caustic 162 with a second caustic such as Tschirnhausen's spline 140 will provide a corresponding involute curve 164 in the manner as was provided with the embodiments of FIGS. 5 and 6. Once again, the lengths of line segments 166, 168 from circularly shaped caustic curve 162 to reflector 160 are equal to the line lengths of line segments 170, 172 from reflector 160 to involute 164, respectively. Viewed in another way, the construction of reflector surface 140 is a mechanical operation where line segments 166, 168 represent a string wound around circularly shaped caustic curve 162 and spline 140. The string has enough slack such that if a pencil stretches the string taut and is moved clockwise such that the string is wound onto caustic 162 and unwound from spline 140 simultaneously a curve representing reflector 160 is generated.

In the embodiment shown in FIG. 6, it was determined that a particular curve, such as nephroid curve 144, provides efficient reflection of light rays from light fixture 10. Accordingly, an alternate embodiment utilizes a nephroid curve provided without performing the operation of co-involution. Instead, a mathematically described nephroid curve can be used for rear portion 50 of reflector 12. One example of a nephroid curve 144 is expressed by the equation $(r/2h)^{2/3}=(\sin\theta/2)^{2/3}+(\cos\theta/2)^{2/3}$, with r being the radius vector from the center of the circular cross-section of the lamp, h being the cusp focal distance (distance between the center of the lamp and the cusp), and $\theta$ being the angle of the radius vector. The radius vector r and cusp focal distance h are selected such that nephroid curve fits within troffer 14.

In the examples described above and shown in FIGS. 5 and 6, single caustic curves 110, 140 are used to generate either part or all of rear curved portion 50, respectively. However, the geometry of troffer 14 may require that more than one caustic or a family of caustic curves be used to generate the shape of rear portion 50 which will reflect any light ray emitted from lamp 16 out of troffer 14. With such troffer geometries, rear portion 50 would be divided into smaller curved portions, each portion associated with a separate caustic curve and involute pair.

Figure 8:
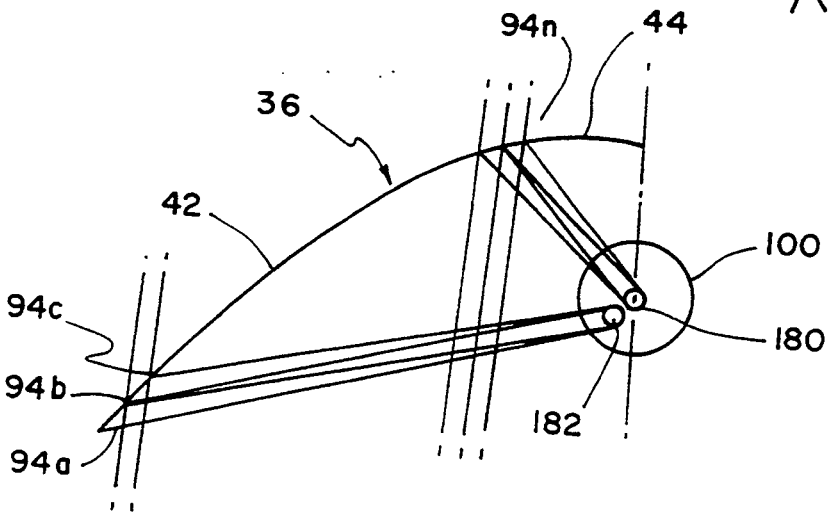
FIG. 8 is a diagrammatic view of an alternative method for determining the curvature of curved side and rear portions of the lamp reflector of FIG. 1

On the other hand, the curve-fitting approach for providing side curved portion 48 (described in conjunction with FIG. 4) can be extended to generate rear portion 50. However, using a lamp image 90 having a diameter D being one half the actual diameter of lamp 16 (See FIG. 4) at rear portion 50 will generally provide a pair of curve-fitting points spaced too widely to determine a shape for rear curved portion 50 needed to direct light rays to area of illumination 49 with a single reflection. Referring to FIG. 8, it is clear that decreasing the lamp image diameter, provides a greater number of curve-fitting points **94*a*–94*n* which results in a better approximation of the curve. For this reason, in applications in which the curve fitting approach is used to generate the curved shape of rear portion 50, smaller lamp images 180, 182 disposed within the periphery of lamp 16, as shown in FIG. 8 should be used. In addition, reduced-sized lamp image 182 are moved to different positions within the perimeter of lamp 16**. The positions are determined empirically and are generally placed where the average amount of flux occurs.

Figure 9:
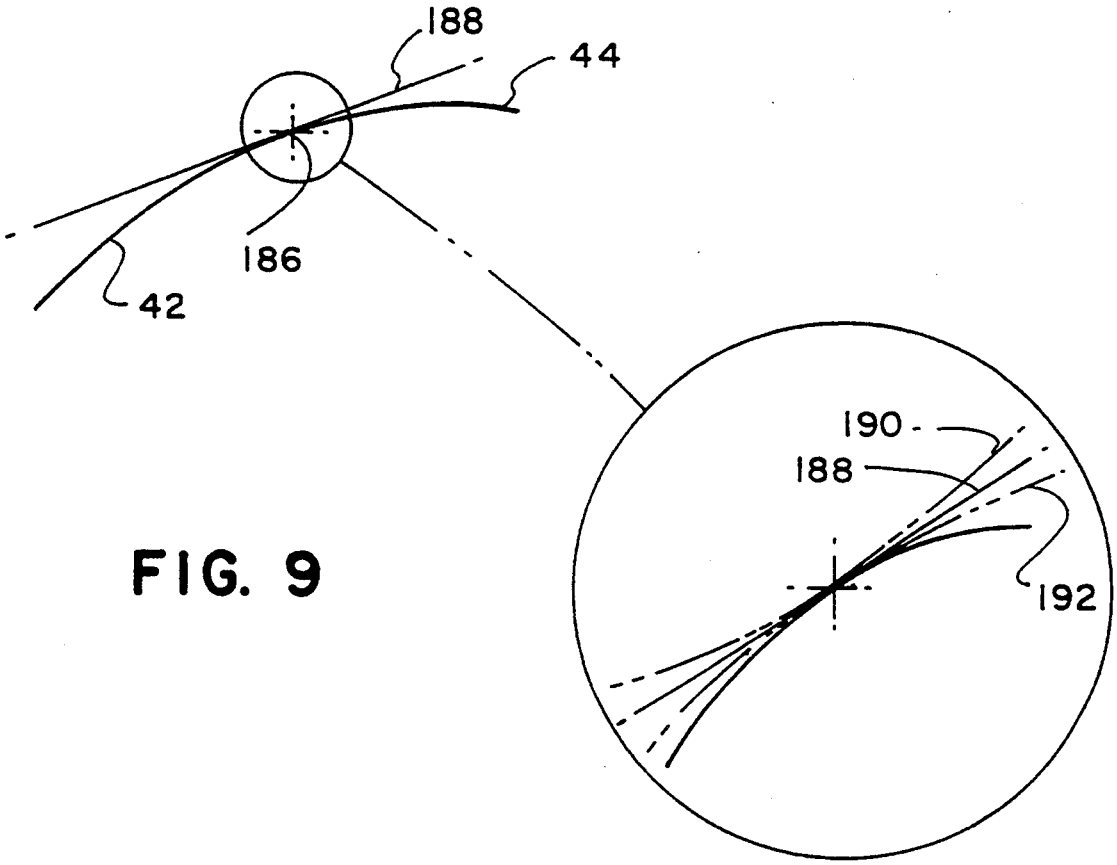
FIG. 9 is a diagrammatic view illustrating a method for merging curved side and rear portions of the lamp reflector of FIG. 1.

In applications where side curved portion 48 is developed independently from rear curved portion 50, the separate curves may be joined in a way that their combination provides a single unsegmented reflector curve. Referring to FIG. 9, point 186 represents the junction of side curved portion 48 and rear curved portion 50. A tangent line 188 through point 186 is determined such that lines 190 and 192 (dashed) each tangent to points immediately adjacent to and on opposite sides of junction point 186, respectively, have slopes which oppose each other with respect to tangent line 188.

Figure 10:
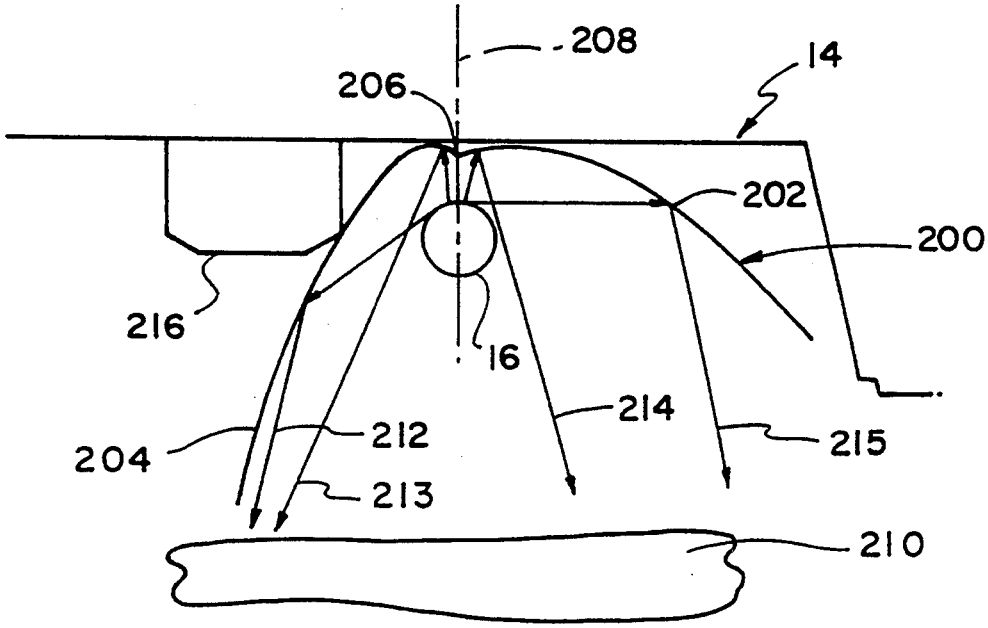
FIG. 10 is a diagrammatic view of an asymmetric lamp reflector.

As shown in FIG. 10, in an alternate embodiment, an asymmetric lamp reflector 200 is shown disposed within a troffer 14 to reflect light reflected from a lamp 16. Reflector 200 has a pair of concave curved members 202, 204 attached at a spine portion 206 defining a cusp. Each of concave curved surfaces 202, 204 are generated using any one of the above described methods of curve-fitting, co-involuting, or mathematically describing shapes to generate an efficient light reflector 200. Unlike reflector 12 (See FIG. 2), curved surfaces 202, 204 of reflector 200 are differently shaped and are asymmetric about a diametric axis 208 extending from behind lamp 16 to a desired area of illumination 210. Although the shape of reflector 200 is asymmetric, light rays 212–215 emitted from lamp 16 and incident upon curved members 202, 204 are still directed to area of illumination 210 with generally a single reflection. Asymmetric lamp reflectors are used in applications which require special photometric light distributions or to provide clearance from hardware within the fixture, such as a ballast 216. End members 22, 24 may also have curved concave surfaces developed using any of the above described techniques.

What is claimed is:

1. A lamp reflector for directing light emitted from a lamp towards an area desired to be illuminated, said lamp being elongated along a longitudinal axis that is generally parallel to the area of illumination, said lamp reflector comprising at least one continuously curved member that is disposed along said longitudinal axis, said member including:

a first curved portion having a first end disposed in a region behind said lamp with respect to said area desired to be illuminated, said first curved portion extending transversely about said longitudinal axis and toward the area of illumination to a second end disposed in a side region of said lamp, said first curved portion having a shape that is expressed by a first function that describes a nephroid curve, and a second curved portion having a first end disposed adjacent to said second end of said first curved portion, said second curved portion extending transversely about said longitudinal axis and from the first end thereof toward said area desired to be illuminated, said second curved portion having a shape that is expressed by a second function different from said first function.

2. The lamp reflector of claim 1 wherein said lamp has a diametric axis disposed transverse to said longitudinal axis and extending from said region behind said lamp toward said area desired to be illuminated, said first end of said first curved portion being disposed on said diametric axis.

3. The lamp reflector of claim 1 wherein said second function represents a parametric equation.

4. The lamp reflector of claim 1 wherein said second function describes a conic section.

5. The lamp reflector of claim 1 wherein said nephroid curve is defined by the equation $(r/2h)^{2/3}=(\sin \theta/2)^{2/3}+(\cos \theta/2)^{2/3}$, wherein r is the radius vector from the center of the circular cross-section of said lamp, h is the cusp focal distance and $\theta$ is the angle of said radius vector.

6. The lamp reflector of claim 1 wherein said lamp has a diametric axis disposed transverse to said longitudinal axis and extending from said region behind the lamp toward said area desired to be illuminated, said lamp reflector further comprising a second said at least one continuously curved member disposed along said longitudinal axis, said second curved member including a said first curved portion and a said second curved portion and being disposed on an opposite side of said diametric axis from the first-mentioned continuously curved member.

7. The lamp reflector of claim 6 wherein the first mentioned continuously curved member and said second continuously curved member are joined along said diametric axis at said region behind said lamp.

8. The lamp reflector of claim 6 wherein the first mentioned continuously curved member and said second continuously curved member are symmetrical about said diametric axis of said lamp.

9. The lamp reflector of claim 6 wherein said first continuously curved member has a different shape than said second continuously curved member.

10. The lamp reflector of claim 6 wherein said first and second continuously curved members are asymmetrical about said diametric axis of said lamp.

* * * * *